United States Patent [19]

Brütsch

[11] Patent Number: 4,884,693

[45] Date of Patent: Dec. 5, 1989

[54] PACKAGE

[75] Inventor: Emil Brütsch, Basel, Switzerland

[73] Assignee: Sandoz Ltd., Basel, Switzerland

[21] Appl. No.: 252,087

[22] Filed: Sep. 30, 1988

Related U.S. Application Data

[63] Continuation of Ser. No. 132,297, Dec. 15, 1987, which is a continuation of Ser. No. 896,573, Aug. 18, 1986, abandoned, which is a continuation of Ser. No. 677,961, Dec. 4, 1984, abandoned.

[30] Foreign Application Priority Data

Dec. 9, 1983 [GB] United Kingdom ..... 8332933
Mar. 15, 1984 [GB] United Kingdom ..... 8406730

[51] Int. Cl.[4] ..... B65D 85/48
[52] U.S. Cl. ..... 206/470; 206/538

[58] Field of Search ..... 206/470, 461, 467, 538, 206/531, 532, 540

[56] References Cited

U.S. PATENT DOCUMENTS

| | | | |
|---|---|---|---|
| 3,448,853 | 6/1969 | Repko | 206/470 |
| 3,463,309 | 8/1969 | Szostek | 206/470 |
| 4,383,607 | 5/1983 | Lordahl et al. | 206/45.34 |
| 4,512,474 | 4/1985 | Harding | 206/461 |

*Primary Examiner*—Joseph Man-Fu Moy
*Attorney, Agent, or Firm*—Gerald D. Sharkin; Robert S. Honor; Walter F. Jewell

[57] ABSTRACT

A blister packaging card which contains a closure means for at least one blister which is integral with the card. The card can be prepared from a single sheet (1) comprising a series of blisters (2) at least one pair of which (3, 4) is adapted to mutually engage.

1 Claim, 2 Drawing Sheets

PACKAGE

This is a continuation of application Ser. No. 132,297, filed Dec. 15, 1987, which in turn is a continuation of application Ser. No. 896,573, filed Aug. 18, 1986, now abandoned, which in turn is a continuation of application Ser. No. 677,961, filed Dec. 4, 1984, now abandoned.

The present invention relates to packaging for discrete small bodies.

A particular type of known package extensively employed in the pharmaceutical industry is the so-called blister or push through package which comprises essentially a hard blistered sheet, usually formed from hard transparent plastic such as PVC, containing within the blisters the items to be packaged and sealed e.g. with a hard aluminium film which can be rupturable or a laminated aluminium plastic film provided with means for its to be pulled off to allow access to a packaged item. A single such blister packaging card (also known as blister platform) usually consists of parallel rows of blisters.

Recent advances in pharmaceutical and galenical research have enabled medicaments to be made available which can be administered at greatly reduced daily dosages thus allowing an ideal dosage for a particular patient to be more accurately prescribed. Thus a patient with a relatively mild condition may require only half or one quarter of the dosage required by a more severely afflicted person.

This possibility of tailor-made prescribing does, however, present problems with respect to the galenical formulation and the packaging of suitable dosage forms. Various possibilities exist e.g.

(1) Formulation of individual forms (e.g. tablets) each having a different content of active substance.

(2) Formulation of a single form having the lowest dosage content.

(3) Formulation of a single form having the highest dosage content provided with a means for dividing the form (e.g. with tablets, lines of scoring).

The first alternative whilst allowing for a high degree of flexibility has a number of disadvantages such as economic considerations -necessity of separate production runs for formulating, packaging, labelling etc.; necessity of separate registration of each form with the health authorities; danger of confusion.

The second alternative whilst eliminating the need for separate production runs involves increased costs in providing sufficient unit dosage forms for all dosage regimes. This alternative has the added disadvantage of low patient acceptability particularly with patients having to take a large number of unit dosages to achieve the prescribed daily dosage.

The third alternative avoids the disadvantages of the first two and is thus the preferred method of formulation/packaging.

One main problem which remains with this latter method is to provide the patient with a means for conserving fractions e.g. of tablets in a convenient and hygenic manner at the same time minimising the risk of misplacement. This is of particular importance when dosage forms are packaged to facilitate regular consumption for a more or less prolonged period (calendar packaging).

Two methods proposed for solving this problem are (a) provision of an "empty" blister covered by a removable and replaceable adhesive strip (b) provision of a separate container (pill-box) enclosed in a blister on the card for subsequent removal and use.

Alternative (a) has the disadvantage that the adhesive properties of the strip wear-off in use and on contact with dust or other particles e.g. if carried in pockets, handbags or on contact with fatty substances e.g. greasy fingers. The low stability of the adhesive layer also seriously diminishes the shelf life of the package.

Alternative (b) whilst largely avoiding these problems has the disadvantage that once removed the pill-box is kept separately (danger of misplacement and if refound confusion as to content) and that its incorporation involves extra material costs (e.g. the pill-box itself) and an extra production run/machine part.

The present invention avoids these problems by providing a system which allows fractions of e.g. tablets to be kept together with the blister packaging card in a stable, reusable and hygenic enclosure and which can be prepared on existing machines e.g. by simple substitution of dies.

The invention therefore provides a blister packaging card including a closure means for at least one blister thereof which removeably seals said blister to form an enclosed cavity and is integral with the card.

In a preferred form the blister packaging card comprises a series of blisters at least one pair of which is adapted to mutually engage to form a sealed cavity.

In a particular form a negative and a positive blister are formed adjacent to each other, means being provided for one blister to fold back and engage the other to seal the cavity. The positive blister being that protruding from the plane of the packaging card in the same direction as the tablet containing blisters. For example the flange surrounding positive or negative blister can be constructed to be free from or severable from the remainder of the card on three sides e.g. by suitable perforation whereupon it may be folded back along the remaining side which is adjacent to the blister to be sealed. This is conveniently done by locating the blister pair in question at the end of a packaging card and perforating the third side of the flange. The flange between the negative and positive blister may be provided with means to facilitate folding back e.g. one or more score lines. The score lines can be advantageously positioned so that upon folding back the flange surrounding one blister will extend beyond the flange surrounding the blister with which it engages to provide a tab as an aid to reopening of the sealed cavity.

The means of engagement of two blisters can take various forms. For example where positive and negative blisters are involved one of the two blisters can be formed in such a way that it is deeper than the other and that its diameter proximal to the plane of the packaging card is greater than that of the other blister and decreases distally from the plane of the card to the same or less than that of the other blister. Thus, folding back and locating the one blister in the other followed by pressure completes the closure in the manner of a press-stud fastening whilst leaving the desired cavity. The blister packaging card can be formed in conventional manner using suitable draw-down and stamp dies in the case of the former applying compressed air from above.

It is preferable that the deeper of the two blisters be formed over a positive stud on the die rather than by drawing down into a well. This allows for increased strength and durability for repeated closure. The portion of the card carrying the dosage forms (usually tablets) is also conventional and consists e.g. of one row or two parallel rows of blisters sealed e.g. as described above with aluminium. The sealing film may extend over the cavity forming blisters but preferably does not.

Perforation can be provided between individual blisters but in the case of calendar packaging is usually not.

In an alterantive arrangement a positive storage blister is formed adjacent to the portion forming the end of the packaging card these two portions being separated by a score line which facilitates folding back of said end portion to cover the blister. The area of end portion covering the blister is substantially planar. The sealing means in this case can be provided e.g. by one or more press-stud like blister arrangements the positive and negative integers of which are located on the end-portion (flap) and storage blister bearing port-on respectively (or vice-versa) in such a way as to engage upon folding back the flap.

The remainder of the blister package card is again conventional.

It will be appreciated from the above description that a preferred manner of integrating the closure means is formation thereof together with the tablet containing blisters from a singel sheet e.g. of plastic material. It will further be appreciated that in embodiments where the closure means comprises mutually engaging blisters these can be independant of the cavity for retention of the tablet fraction or can themselves form the cavity e.g. as described hereinafter with reference to FIGS. 4 and 5 and 1, 2 and 3 respectively. p A particular embodiment of the invention is described with reference to the attached figures.

Figure 1:
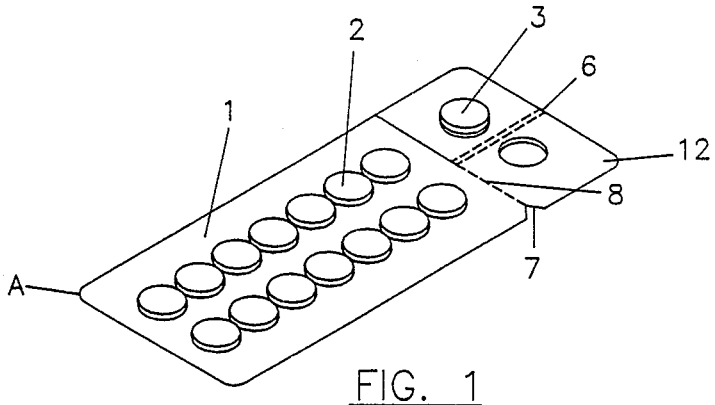
FIG. 1 shows an isometric plan view of a packaging card as initially formed.

The corner A is marked to show the relative position of the two views.

The card comprises a hard transparent plastic sheet made for example from PVC 1 in which a series of positive blisters 2 are formed to contain tablets (for convenience not shown). A further positive blister 3 and a negative blister 4 are provided which will form an enclosed cavity unit 5. The card also bears two lines of score 6, a cutaway portion 7 which facilitates severance of perforation 8. Perforation 8 extends across the card from one edge to the lines of score 6. The blisters containing tablets 2 are sealed with a film 9 e.g. of aluminium. The positive blister 3 is so-formed that over the portion thereof 10 proximal to the plane of the card its diameter is greater than that of negative blister 4.

The blister tapers distally over the portion 11 to an end diameter equal to or slightly less than that of blister 4 thus providing, when closed, a cavity 14.

Score lines 6 are positioned such that when the negative and positive blisters 3 and 4 are engaged a tab 13 extends beyond the edge of the card.

In use the line of perforation 8 is severed and the flange 12 containing blister 4 is folded along score lines 6. The card is then turned over and the fraction of the tablet to be conserved placed inside blister 3. Blister 4 is then turned back through 180° and pressed into blister 3 thus engaging same and forming the sealed cavity 14. To reopen and release the tablet fraction blister 4 is disengaged by lifting flange 5 at tab 13.

A further particular embodiment is described with reference to FIGS. 4 and 5.

Figure 4:
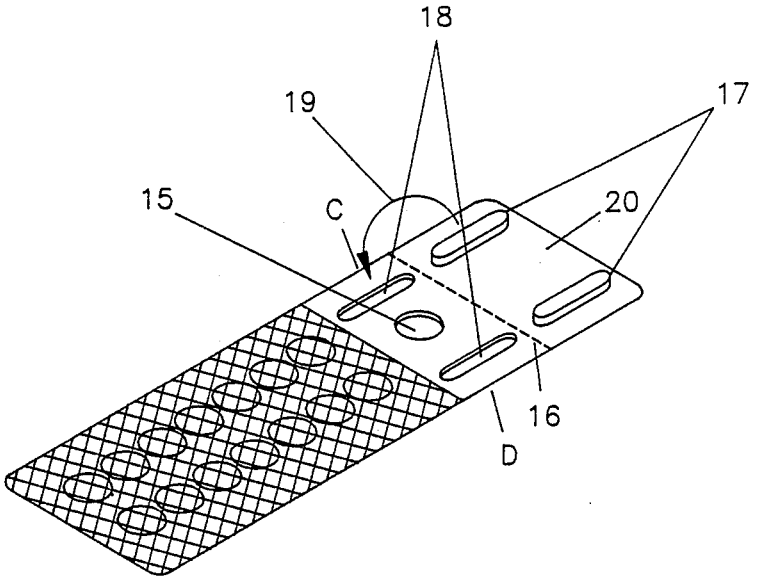

FIG. 4 shows an isometric under-plan view of card.

Figure 5:
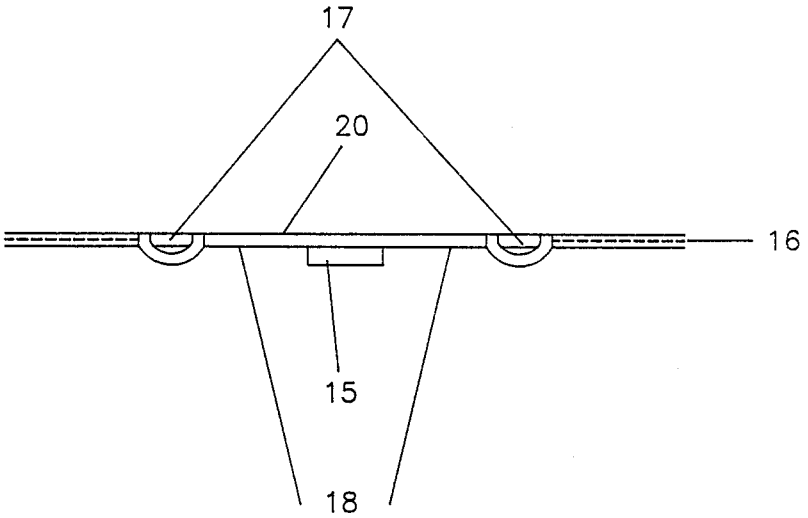

FIG. 5 shows a cross-section along the line C - D in side elevation.

The unshaded portion of the card is provided with a positive blister 15 separated from the flap-like end portion 20 by a score-line 16. The flap portion is provided with two negative integers 17 of a press-stud arrangement, the positive integers 18 of which are correspondingly located in the portion of the card carrying the positive blister 15.

Figure 2:
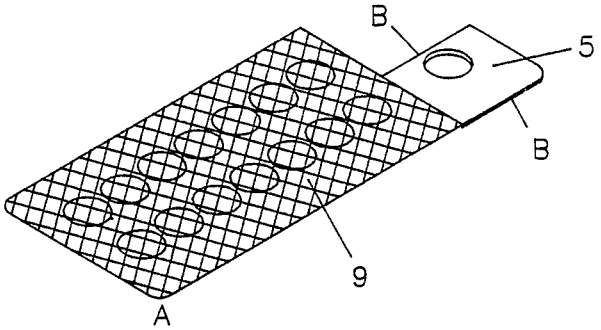
FIG. 2 shows an isometric under-plan view of the card with two adjacent blisters mutually engaged.
Figure 3:
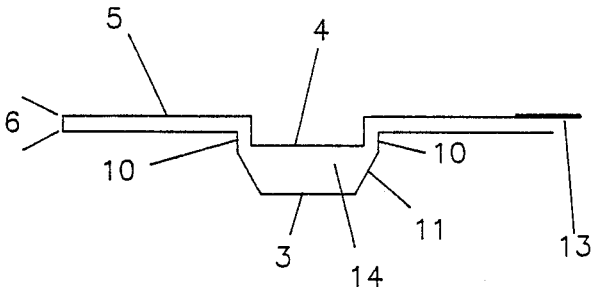
FIG. 3 shows a cross-section of an enclosed cavity unit along the line B—B of FIG. 2 in side elevation.

The shaded portion of the packaging card is as described for FIGS. 1 to 3.

In use the flap 20 is folded back in the direction of arrow 19 about the line of scoring 16. The fraction of the tablet to be conserved is placed in blister 15 and the flap 20 folded back through 180°. The negative integers 17 are pressed in positive integers 18 engaging same and forming the sealed cavity (20 over 15). To reopen and release the tablet fraction the flap is disengaged.

We claim:

1. A blister packaging card including closure for at least one blister thereof said closure means being provided by a negative and positive blister located at the end of the card which are adapted to mutually engage to form a sealed cavity and are integral with the card one of said blisters being detachably engaged on one side thereof to the packaging card whereby said blister when detached from the packaging card along said one side may be folded flap-like to engage and removably seal the other blister.

* * * * *